US006887296B2

(12) United States Patent
Mende et al.

(10) Patent No.: US 6,887,296 B2
(45) Date of Patent: May 3, 2005

(54) POWDER MIXTURE OR COMPOSITE POWDER, A METHOD FOR PRODUCTION THEREOF AND THE USE THEREOF IN COMPOSITE MATERIALS

(75) Inventors: Bernd Mende, Bad Harzburg (DE); Gerhard Gille, Goslar (DE); Ines Lamprecht, Rhüden (DE)

(73) Assignee: H.C. Starck GmbH, Goslar (DE)

( * ) Notice: Subject to any disclaimer, the term of this patent is extended or adjusted under 35 U.S.C. 154(b) by 12 days.

(21) Appl. No.: 10/168,272

(22) PCT Filed: Dec. 11, 2000

(86) PCT No.: PCT/EP00/12484

§ 371 (c)(1),
(2), (4) Date: Jun. 18, 2002

(87) PCT Pub. No.: WO01/46484

PCT Pub. Date: Jun. 28, 2001

(65) Prior Publication Data

US 2003/0000340 A1 Jan. 2, 2003

(30) Foreign Application Priority Data

Dec. 22, 1999 (DE) ..... 199 62 015

(51) Int. Cl.[7] ..... B22F 9/24
(52) U.S. Cl. ..... 75/351; 75/365; 75/369
(58) Field of Search ..... 75/351, 365, 369

(56) References Cited

U.S. PATENT DOCUMENTS

| | | | | |
|---|---|---|---|---|
| 3,923,496 A | | 12/1975 | Pall | 75/0.5 AA |
| 3,925,114 A | * | 12/1975 | Takahashi et al. | 75/348 |
| 5,248,328 A | | 9/1993 | He et al. | 75/352 |
| 5,338,714 A | * | 8/1994 | Rousset et al. | 75/343 |
| 5,352,269 A | | 10/1994 | McCandlish et al. | 75/351 |
| 5,439,638 A | | 8/1995 | Houck et al. | 419/30 |
| 5,468,457 A | | 11/1995 | Dorfman et al. | 423/61 |
| 5,470,549 A | | 11/1995 | Dorfman et al. | 423/61 |
| 5,505,902 A | | 4/1996 | Fischer et al. | 419/10 |
| 5,529,804 A | | 6/1996 | Bonneau et al. | 427/217 |
| 5,759,230 A | | 6/1998 | Chow et al. | 75/362 |

FOREIGN PATENT DOCUMENTS

| | | |
|---|---|---|
| EP | 0 846 658 | 6/1998 |
| GB | 346743 | 4/1931 |
| GB | 383327 | 11/1932 |
| WO | 95/26843 | 10/1995 |
| WO | 97/11805 | 4/1997 |

OTHER PUBLICATIONS

Gille, Szesny, Leitner; Proceedings of the 14$^{th}$ International Plansee Seminar, Eds. G. Kneringer, P. Roedhammer and P. Wilhartitz, Plansee AG, Reutte (1977), vol. 2, pp. 139–167 "A new 0.4 $\mu$m WC Powder as well as powder–related properties and sintering behaviour of 0.6 to 30 $\mu$m WC–Co hardmetals".

Ullmann's Encyclopedia of Industrial Chemistry, Sixth, Completely Revised Edition, vol. 16, Wiley–VCH, "Gold, Gold Alloys and Gold Compounds to Hydrides", pp. 139–143.

* cited by examiner

*Primary Examiner*—George Wyszomierski
(74) *Attorney, Agent, or Firm*—Joseph C. Gil; James R. Franks

(57) ABSTRACT

A process is described for the preparation of powder mixtures or composite powders from at least one first type of powder from the group consisting of high-melting metals, hard materials and ceramic powders and at least one second type of powder from the group consisting of binder metals, binder-metal mixed crystals and binder-metal alloys, where the second type of powder is formed from precursor compounds in the form of water-soluble salts in an aqueous suspension of the first type of powder by precipitation as oxalate, removal of the mother liquor and reduction to the metal.

17 Claims, 7 Drawing Sheets

SEM SEI

Figure 1:
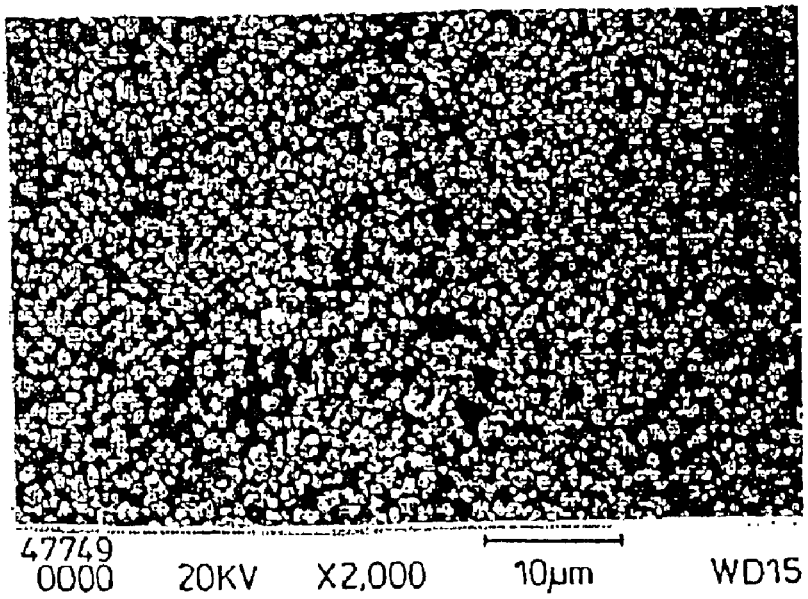

SEM EDX
Co-Kα
distribution

SEM SEI

SEM EDX
Co-$K_\alpha$
distribution

SEM SEI

SEM EDX
Fe distribution

SEM EDX
Co distibution

SEM EDX
Ni distribution

SEM SEI

SEM EDX
Fe distribution

SEM EDX
Ni distribution

SEM SEI

SEM EDX
Cu distribution

POWDER MIXTURE OR COMPOSITE POWDER, A METHOD FOR PRODUCTION THEREOF AND THE USE THEREOF IN COMPOSITE MATERIALS

The present invention relates to powder mixtures and composite powders which consist of at least two types of powder or solid phases in disperse form and which are employed as precursors for particle composite materials or as spray powders for surface coatings. With respect to the composition, these composite powders comprise high-melting metals (such as, for example, W and Mo) or hard materials (such as, for example, WC, TiC, TiN, Ti(C,N) TaC, NbC and $Mo_2C$) or ceramic powders (such as, for example, $TiB_2$ and $B_4C$) on the one hand and binder metals (such as, for example, Fe, Ni, Co, Cu and Sn) or mixed crystals and alloys of these binder metals on the other hand.

The invention furthermore relates to processes for the preparation of these composite powders and their use for particle composite materials and spray powders. The most important applications as particle composites are hard metals, cermets, heavy metals and functional materials having special electrical (contact and surface materials) and thermal properties (heat sinks).

The effective properties of these particle composites, such as, for example, hardness, modulus of elasticity, fracture toughness, strength and wear resistance, but also electrical and thermal conductivity, are determined, in particular, by the degree of dispersion, the homogeneity and the topology of these phases and by structural defects (pores, impurities), besides the properties and proportions of the phases. These structural characteristics of particle composites are themselves determined by the pulverulent precursors and their powder-metallurgical processing (pressing, sintering) to give compact materials.

The prior art includes various technologies for preparing precursors of this type, i.e. mixtures of at least two types of powder. Without restricting the generality, the prior art, the disadvantages associated therewith and the essence of this invention are described using the example of hard metals and W/Cu and Mo/Cu composites.

Hard metals are particle composites comprising at least two phases, the WC hard material phase hard material phase (97–70 m %) and the eutectic Co/W/C binder metal phase (3–30 m %), which forms through dissolution of W and C in Co during liquid-phase sintering and binds the WC particles. Depending on the application (cutting tools for steels, cast steel and gray cast iron, nonferrous metals, concrete, stone and wood or wearing and construction parts), the hard metals may comprise further hard material phases, such as the cubic (W, Ti) and (W, Ta/Nb) mixed carbides with proportions of from 1 to 15 m %. If the hard metals are subject to particularly strong corrosive attack, all or some of the Co-based binder is replaced by Ni, Cr(Fe) alloys, and in microgram hard metals, dopant additives, such as, for example, VC and $Cr_3C_2$ ($\leqq$1 m %) are used to control grain growth and structure formation.

The hard material particles (WC and mixed carbides) are carriers of the hardness, wear resistance and high-temperature properties, while the binder metals determine principally the fracture toughness, the thermal shock stability and the bending strength. Hard metals are distinguished, in particular, by very favorable combinations of hardness and toughness as well as high-temperature stability and wear/corrosion resistance. This is achieved through either the hard material particles being bound in completely dispersed form in the binder metal or through two interdiffusing phase regions of hard material and binder forming with decreasing binder metal content. In the case of sintering, this structure formation proceeds in parallel to densification of the compact. The densification during the sintering process takes place to the extent of 70–85% of the increase in density at the stage of solid-phase sintering, i.e. the WC grains move into energetically preferred layers under the action of the binder metal which flows in a viscous manner and provides wetting, see, for example, GILLE, SZESNY, LEITNER; Proc. $14^{th}$ Int. Plansee Seminar, Vol. 2, Reutte 1997. Finally, the eutectic composition is achieved via simultaneous diffusion of W and C into the Co particles, and the binder metal melts. The remaining 15–30% of the densification then takes place via further particle transpositions and pore filling with liquid binder. The end phase of the densification and structure formation takes place by OSTWALD ripening, i.e. small hard material particles dissolve in the liquid binder owing to the higher solution pressure and re-precipitate on larger, adjacent hard material particles. This re-dissolution results in an increase in the particle size and determines the final hard material/binder topology. Particularly important with respect to the present invention is the face that up to 85% of the densification and structure formation take place at the stage of solid-phase sintering, and this in turn is highly characterized by the properties and quality of the precursors, i.e. the composite powders.

The state of the art in hard metal production is described, for example, in SCHEDLER, Hartmetall für den Praktiker [Hard Metal for the Practitioner], Düsseldorf, 1988. The separately prepared hard material and binder metal powders are firstly weighed out in accordance with the hard metal composition, mixed and ground. Depending on the hard metal type, the WC starting powders have particle sizes in the range from 0.5 . . . 50 $\mu$m, are usually slightly agglomerated and must have chemical purity. Due to the variation in the WC particle sizes and the binder-metal contents of between 3 and 30 m %, important properties, such as hardness, toughness and wear resistance, may vary to a great extent and are matched to the specific application.

In the wet grinding which is universally used today, the various powder constituents are converted into a microdisperse mixture. The grinding liquid used is an organic liquid, such as, for example, hexane, heptane, benzine, tetralin, alcohol or acetone. Although grinding liquid and medium (hard-metal balls) enable a highly disperse distribution of the powder particles, take-up of moisture and gas and oxidation of the powders sets in to an increased extent, however, with increasing fineness and degree of dispersion, in spite of the organic grinding liquid. After the grinding, the powder mixture is separated from the grinding liquid by sieving off the grinding balls and evaporation, dried and optionally granulated. The grinding is carried out predominantly in attritors and ball mills, sometimes also in vibration mills. The dominant form of drying today, which has been used in industry for about 20 years, is spray-drying under an inert gas with simultaneous granulation of the composite powders. The dried and optionally granulated mixtures are pressed, extruded or converted into moldings by injection molding (MIM) and subsequently sintered. The actual densification process is preceded by dewaxing, i.e. the expulsion of pressing auxiliaries and pre-sintering for deoxidation and pre-compression. The sintering is carried out either under reduced pressure or under inert-gas pressure of up to 100 bar at temperatures between 1350 and 1500° C.

This standard hard-metal production process detailed above, which dominates on an industrial scale, has the following disadvantages with respect to production of the mixture (production of the composite powder) by wet grinding:

The process is time-consuming, energy-intensive and expensive. The grinding durations are typically 8–15 hours in attritors and 50–120 hours in ball mills, and the organic grinding liquids mean that explosion-protected plant technology is necessary. In addition, the plant technology is very bulky, since only about 20% of the volume in a grinding vessel is taken up by the powder mixture, the remainder by empty space, grinding balls and grinding liquid.

Wear of the expensive grinding balls (hard metal) and the grinding vessels (V2A steel) causes high costs and contamination of the mixture.

The uptake of moisture and gas results in oxidation of the powders, hinders the sintering behavior and can result in porosity and thus in an impairment of properties, in particular the strength. This must be countered by correspondingly complex measures during pre-sintering and sintering, for example by deoxidation using $H_2$ and adequate degassing before the dense sintering.

The ductility of the binder metals may result, during grinding, in the powders not only being deagglomerated or more finely dispersed, but, by contrast, in flakes or other types of unfavorable shapes being plastically deformed and molded. This applies in particular in the case of the binder metals having a fcc structure which have particularly good plastic deformability, and can result in inhomogeneous binder distribution and strength-reducing pores in the sintered hard metal.

The wet grinding can at best effect complete deagglomeration, partial breaking-up of primary particles and a homogeneous, microdisperse distribution of the powder components. However, it is not possible to achieve a specific phase topology which is advantageous for further processing, such as, for example, coating of the hard material particles with binder metal (composite sphere).

In accordance with these disadvantages of wet grinding under organic grinding liquids which are currently used virtually exclusively, various proposals have been put forward and technologies developed for eliminating these disadvantages.

Thus, it is proposed in GB-A 346,473 to coat the hard material particles electrolytically with a coating of the binder metal in order to circumvent complex grinding with all its disadvantages. However, this process is not suitable for an industrial scale owing to the inconvenient handling and in addition has the disadvantage that only one metal, but not a plurality of homogeneously mixed metals, can be applied to the hard material particles, since different metals generally have different electrochemical deposition potentials.

WO 95/26843 (EP-A 752,922, U.S. Pat. No. 5,529,804) describes a process in which hard material particles are dispersed in polyols having reducing properties, such as, for example, ethylene glycol, with addition of soluble cobalt or nickel salts. At the boiling temperature of the solvent and with a reduction time of 5 hours, cobalt or nickel is deposited on the hard material particles. The resultant composite powder does indeed produce dense grain structures in the hard metal alloy. However, the attached SEM photographs show that relatively coarse hard material particles having diameters of 3–5 $\mu$m were employed for the coating with respectively one binder metal.

Furthermore, the attainment of economically acceptable yields of binder metals in this process requires the use of 5–40 moles of reducing agent per mole of metal component, and the volatile compounds formed during the reaction (alkanals, alkanones, alkanoic acids) have to be distilled off. No information is provided on disposal of these undesired by-products and the whereabouts of the large amount of excess reducing agent, which also contains by-products. The long reducing time that is necessary restricts the throughput capacity of the process. These conditions inevitably result in high process costs.

According to WO 97/11805, the process of reduction with polyols in accordance with WO 95/26843 is modified in order to reduce the enormous excess of reducing agents and to improve the economic efficiency. The reduction reaction in the liquid phase is terminated after consumption of a stoichiometric amount of polyol, based on the amount of metal used, in order to suppress the formation of undesired by-products and to be able to recirculate the excess polyol. The hard material/metal intermediate is filtered and subsequently reduced by dry means under hydrogen at 550° C. and a very long reduction time of about 24 hours to give the finished composite powder. In an alternative embodiment, the hard material is suspended in an aqueous Co- or Ni-containing solution, and a metal compound is precipitated on the surface of the hard material particles by addition of ammonia or a hydroxide. After the solution has been separated off, this intermediate is reduced under hydrogen at elevated temperature. The reduced amount of polyols employed as solvent and reducing agent and the suppression of side reactions must be compensated by a significantly longer post-reduction of the intermediate under hydrogen and at elevated temperature.

According to U.S. Pat. No. 5,759,230, alcohols are likewise utilized in order to reduce metal compounds dissolved therein to the metal or alloy powder or in order to precipitate them as a metal film on a substrate dispersed in the solvent. The substrates employed are, inter alia, glass powder, Teflon, graphite, aluminum powder and fibers.

A further process is described by WO 95/26245 (U.S. Pat. No. 5,505,902). Metal salts from the iron group, for example Co acetates, are dissolved in a polar solvent, for example methanol, and a complexing agent, such as, for example, triethanolamine, is added. A carbon carrier, such as, for example, sugar, can optionally be added. The well deagglomerated hard material is dispersed in this solution and, after subsequent evaporation of the solvent, sheathed with a metal-containing organic layer. In the subsequent thermal process step, the organic sheath of the hard material particles is burned out at 400–1100° C. under nitrogen and/or hydrogen and then reduced to the composite powder in the final step at about 700° C., preferably under hydrogen, and with ignition times of 120–180 minutes. Instead of hydrogen, it is also possible to employ other reducing gases or gas mixtures. It is stated that composite powders formed in this way can be used to give sintered bodies having a pore-free grain structure under conventional conditions. The disadvantages of this process are comparatively high losses of solvent, corresponding safety precautions and double thermal treatment, technical problems due to the handling of high-viscosity mixtures during evaporation of the solvent, and complex purification/disposal of the decomposition products during burning-out of the organic sheath in the first thermal process step.

U.S. Pat. No. 5,352,269 describes the spray conversion process (NANODYNE Inc.). According to this process, firstly aqueous solutions containing, for example, W and Co in suitable concentrations and proportions and prepared, for example, from ammonium metatungstate and cobalt chloride, are spray-dried. The metals W and Co are mixed at an atomic level into the amorphous precursor powders formed in the process. During subsequent carbothermal reduction and carburization under $H_2/CH_4$, $H_2/CO$ and $CO/CO_2$ gas atmospheres, microcrystalline WC particles having particle dimensions of 20–50 nm are formed, but these are highly agglomerated and permeated by or bonded to cobalt regions and, as hollow ball-shaped aggregates, have diameters of about 70 $\mu$m. Although the WC and Co particles are not produced separately in this spray conversion process and are already in the form of a mixture at the end of this process, grinding is nevertheless necessary in order to improve the homogeneity of the phase distribution and especially the pressing and shrinkage behavior. However, the crucial disadvantage of these composite powders is that the low carburization temperature necessary for technical reasons associated with the process ($\leqq$1000° C.) results in highly flawed WC crystal lattices, and this in turn results in strong grain growth during sintering. An increase in the carburization temperature in order to form a more perfect crystal lattices is not possible owing to the presence of the binder metal, since otherwise a sintering process would already commence between the WC and Co.

An analogous procedure as in the last-described patents for hard metal composite powders is described in U.S. Pat. Nos. 5,439,638, 5,468,457 and 5,470,549 for W/Cu composite powders and the composite materials produced therefrom. These W/Cu composites containing 5–30 m % of Cu are used in electrical contacts and switches and in heat sinks and have hitherto predominantly been produced by impregnation of porous W sintered skeleton bodies with liquid Cu. The cited patents are claimed to reduce the difficulties currently still associated with the pure powder-metallurgical process and to assist this technology in achieving a breakthrough by employing improved W/Cu composite powders.

In U.S. Pat. No. 5,439,638, owing to the better mixing and grinding behavior, firstly W oxide and Cu oxide powders are ground with one another and subsequently reduced to metal mixtures using $H_2$. In order to achieve even better mixing of the metal components W and Cu, complex oxides, such as, for example, copper tungstate ($CuWO_4$) are firstly produced by ignition in accordance with U.S. Pat. Nos. 5,468,457 and 5,470,549. During the subsequent reduction using $H_2$, the mixture of W and Cu present in the oxide at an atomic level is utilized to achieve highly disperse W and Cu regions or particles in the metal mixture (W and Cu are virtually insoluble in one another). Although the fineness and degree of dispersion of the powders and the W/Cu composites produced therefrom are significantly better in accordance with this process than in the impregnation process, this is achieved by means of a relatively complex and expensive process, i.e. with tungstate synthesis, reduction and powder-metallurgical further processing. In addition, expensive starting materials, such as, for example, ammonium metatungstate, have to be employed.

Although all these alternative processes avoid complex wet grindings, they still, hr, have the disadvantages that they either cannot be implemented on an industrial scale and/or require a disproportionately large amount of reducing agents, produce a large number and amount of undesired by-products and require long process times. The by-products result in disposal problems and costs. The long process times make the product more expensive. Although special topologies, such as coating of the hard material particles with binder metals, can be achieved in accordance with GB-A 346,473, implementation on an industrial scale has, however, never taken place for process and cost reasons.

It has now been found that composite powders having very good homogeneity, degree of dispersion and optionally also special topology of the components/phases can be prepared by precipitating the desired binder metal powders (phases) as oxalates in initially introduced suspensions which already contain the other components of the composite powder, such as high-melting metal or hard-material or ceramic powders.

The coprecipitation gives a multicomponent suspension having at least two different solid phases, for example the pre-suspended WC particles and the precipitated Co, Fe, Ni, Cu or Sn binder metals. This reaction product is washed and dried, coated thermally under a reducing atmosphere and can then, optionally after agglomeration, be pressed and sintered without further complex grinding. The sintered products produced in this way are at least equivalent or superior to the products produced by conventional processes with respect to porosity, grain formation and mechanical-physical properties.

The present invention relates to a process for the production of powder mixtures or composite powders comprising at least one first type of powder from the group consisting of high-melting metals, hard materials and ceramic powders and at least one second type of powder from the group consisting of binder metals, binder-metal mixed crystals and binder-metal alloys, which is characterized in that the second type of powder is produced from precursor compounds in the form of aqueous salts in an aqueous suspension of the first type of powder by precipitation as oxalate, removal of the mother liquor and reduction to the metal.

Suitable high-melting metals are metals having melting points above 2000° C., such as molybdenum, tungsten, tantalum, niobium and/or rhenium. Molybdenum and tungsten in particular have achieved industrial importance. Suitable hard materials are, in particular, tungsten carbide, titanium carbide, titanium nitride, titanium carbonitride, tantalum carbide, niobium carbide, molybdenum carbide and/or mixed metal carbides and/or mixed metal carbonitrides thereof, optionally with addition of vanadium carbide and chromium carbide. Suitable ceramic powders are, in particular, $TiB_2$ or $B_4C$. It is furthermore possible to employ powders and mixtures of high-melting metals, hard materials and/or ceramic powders.

The first type of powder can be employed, in particular, in the form of finely divided powders having mean particles diameters in the nanometer range up to larger than 10 $\mu$m. Suitable binder metals are, in particular, cobalt, nickel, iron, copper and tin, and alloys thereof.

In accordance with the invention, the binder metals are employed as precursor compounds in the form of their water-soluble salts and mixtures thereof in aqueous solution. Suitable salts are chlorides, sulfates, nitrates or alternatively complex salts. Owing to the ready availability, chlorides and sulfates are generally preferred.

Suitable for precipitation as oxalate are oxalic acid or water-soluble oxalates, such as ammonium oxalate or sodium oxalate. The oxalic acid component can be employed as an aqueous solution or suspension.

In accordance with the invention, the first type of powder can be suspended in the aqueous solution of the precursor compound of the second type of powder, and an aqueous solution or suspension of the oxalic acid component can be added. It is furthermore possible to stir the oxalic acid component in powder form into the suspension containing the first type of powder.

In accordance with the invention, however, it is also possible for the first type of powder to be suspended in the aqueous solution or suspension of the oxalic acid component, and the aqueous solution of the precursor compound for the second type of powder to be added. The mixing of the two suspensions or of the suspension with the solution is preferably carried out with vigorous stirring.

The precipitation can be carried out continuously by simultaneous, continuous introduction into a flow reactor with continuous removal of the precipitation product. It may furthermore be carried out batchwise by initially introducing the suspension containing the first type of powder and introducing the second precipitation partner. In order to ensure uniform precipitation over the precipitation reactor volume, it may be advantageous here to stir the oxalate component in the form of a solid powder into the suspension of the first type of powder and solution of the precursor compound for the second type of powder, in order that the oxalate component can be uniformly distributed before the precipitation takes place through dissolution thereof. Furthermore, the particle size for the precipitation product can be controlled via the depot action of the use of a solid oxalate component.

The oxalic acid component is preferably employed in a 1.02- to 1.2-fold stoichiometric amount, based on the precursor compound for the second type of powder.

The concentration of the oxalic acid component in the precipitation suspension, based on the beginning of the precipitation, can be from 0.05 to 1.05 mol/l, particularly preferably greater than 0.6 mol/l, especially preferably greater than 0.8 mol/l.

When the precipitation is complete, the solid mixture comprising precipitate and first type of powder is separated off from the mother liquor. This can be carried out by filtration, centrifugation or decanting.

This is preferably followed by washing with demineralized water in order to remove adhering mother liquor, in particular the anions of the precursor compound.

After an optionally separate drying step, the solid mixture of the first type of powder and the precipitate is treated under a reducing gas atmosphere at temperatures of preferably from 350 to 650° C. The reducing gas employed is preferably hydrogen or a hydrogen/inert gas mixture, further preferably a nitrogen/hydrogen mixture. In this operation, the oxalate is broken down completely into gaseous components, some of which promote the reduction ($H_2O$, $CO_2$, CO), and the second type of powder is produced by reduction to the metal.

The oxalate decomposition and reduction can be carried out continuously or batchwise and under flowing, reducing gases in an agitated or static bed, for example in tubular furnaces or rotary tubular furnaces or push-through furnaces. Also suitable are any desired reactors which are suitable for carrying out solid/gas reactions, such as, for example, fluidized-bed furnaces.

In the powder mixtures or composite powders obtainable in accordance with the invention, the powders of the first and second types are in part in the form of separate ("powder mixture"), and partly mutually adherent ("composite powders") components in an extremely uniform distribution essentially without formation of agglomerates. They can be processed further without any further treatment. In particular, the powders are suitable for the production of hard metals, cermets, heavy metals, metal-bonded diamond tools or functional materials in electrical engineering by sintering, optionally with use of organic binders for the production of sinterable green bodies. They are furthermore suitable for the surface coating of parts and tools, for example by thermal or plasma spraying or for processing by extrusion or metal injection molding (MIM).

The invention is explained by the following examples without restricting the generality:

EXAMPLES

Example 1

Figure 2:
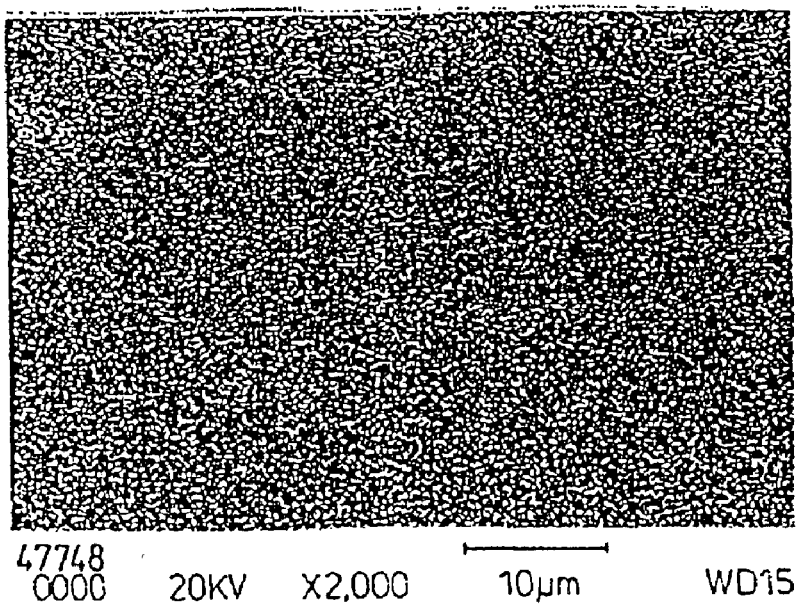

5.02 kg of tungsten carbide (type WC DS 80, supplier H.C. Starck) were dispersed in 5 l of solution prepared by dissolving 2.167 kg of $CoCl_2*6H_2O$ in deionized water. A solution of 1.361 kg of oxalic acid dihydrate in 13 l of deionized water was added over a time of 20 minutes with constant stirring at room temperature, and the mixture was stirred for a further 60 minutes in order to complete the precipitation. The precipitate was filtered via a suction filter, washed with deionized water until chloride was no longer detectable in the filtrate running off, and subsequently spray-dried. The spray-dried powder was subsequently reduced for 90 minutes in a tubular furnace at 500° C. under hydrogen, and the chemical composition and physical properties of this composite powder were measured: Co 9.51%; C total 5.52%; C free 0.04% (in accordance with DIN ISO 3908); O 0.263%; FSSS 0.76 μm (ASTM B 330); particle size distribution by the laser diffraction method d10=1.01 μm, d50=1.83 μm, d90=3.08 μm (ASTM B 822). An SEM analysis (FIG. 1) with energy-dispersive evaluation (FIG. 2) shows a uniform distribution of the cobalt between the tungsten carbide grains.

A hard-metal test with the following procedure was carried out with this powder without any other treatment: production of a green body with a pressing pressure of 150 MPa, heating of the green body to 1100° C. at a rate of 20 K/min under reduced pressure, holding at this temperature for 60 minutes, further heating to 1400° C. at a rate of 20 K/min, holding at this temperature for 45 minutes, cooling to 1100° C., holding at this temperature for 60 minutes and then cooling to room temperature. The following properties were measured on the sintered body: density 14.58 g/cm$^3$; coercive force 19.9 kA/m or 250 Oe; hardness $HV_{30}$ 1580 kg/mm$^2$ or HRA 91.7; magnetic saturation 169.2 Gcm$^3$/g or 16.9 μTm$^3$/kg; porosity A00 B00 C00 in accordance with ASTM B 276 (no visible porosity at a magnification of 200 times under the light microscope) with a flaw-free, microdisperse grain structure. The linear shrinkage of the sintered body was measured at 19.06%.

Example 2

Figure 3:
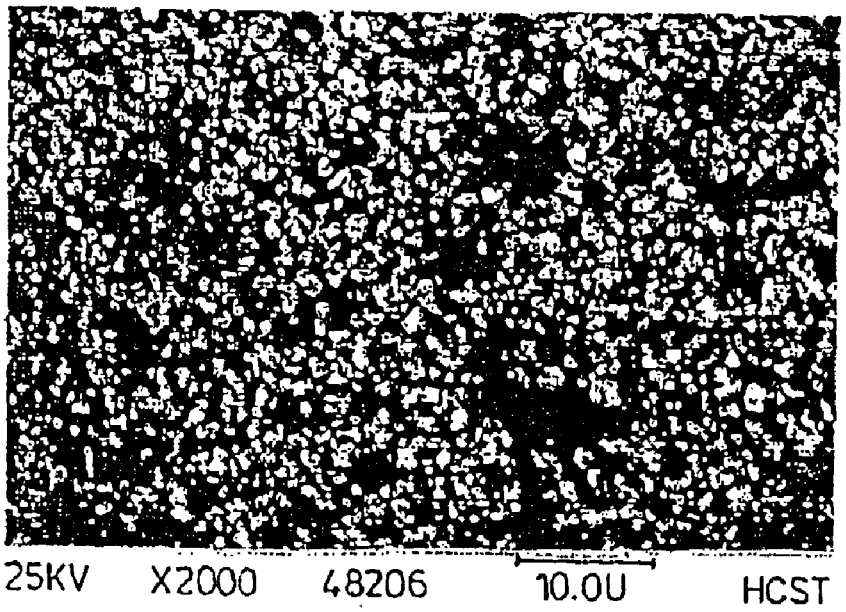
Figure 4:
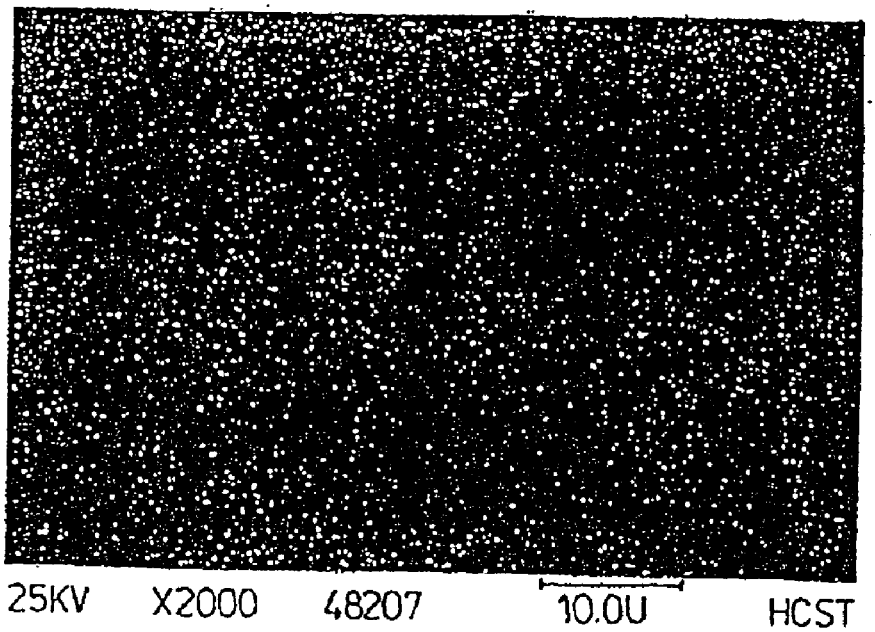

In an alternative embodiment, 2000 g of tungsten carbide of type DS 80 (supplier H.C. Starck) and 1 g of carbon black were homogeneously dispersed for 60 minutes in a suspension of 465.4 g of oxalic acid dihydrate in 1.6 l of deionized water. 2 l of Co solution containing 893.4 g of $CoCl_2*6H_2O$ were then added rapidly, and the mixture was stirred for a further 10 minutes in order to complete the precipitation. After the precipitate had been filtered and washed with deionized water (until chloride was no longer detectable in the run-off), the mixture was spray-dried and subsequently reduced for 90 minutes in a tubular furnace at 420° C. in an atmosphere comprising 4% by volume of hydrogen and 96% by volume of nitrogen. The resultant composite powder comprised 8.24% of Co, 5.63% of carbon total, 0.06% of carbon free (in accordance with DIN ISO 3908), 0.395% of oxygen and 0.0175% of nitrogen. The physical properties were measured as FSSS 0.7 μm, grain size distribution by the laser diffraction method d10=0.87 μm, d50=1.77 μm and d90=3.32 μm. The SEM photomicrographs show in SEI mode a well deagglomerated mixture (FIG. 3) and, on energy-dispersive evaluation, a very uniform distribution of the cobalt in the composite powder (FIG. 4). A hard-metal test was carried out with this powder under analogous conditions to those in Example 1, and the following properties were measured on the resultant sintered body: density 14.71 g/cm$^3$, coercive force 19.1 kA/m or 240 Oe, hardness HV30 1626 kg/mm$^2$ or HRA 92.0, magnetic saturation 157.8 G cm$^3$/g or 15.8 $\mu$Tm$^3$/kg, a low porosity A00 B02 C00, and a homogeneous, microdisperse grain structure.

Example 3

Figure 5:
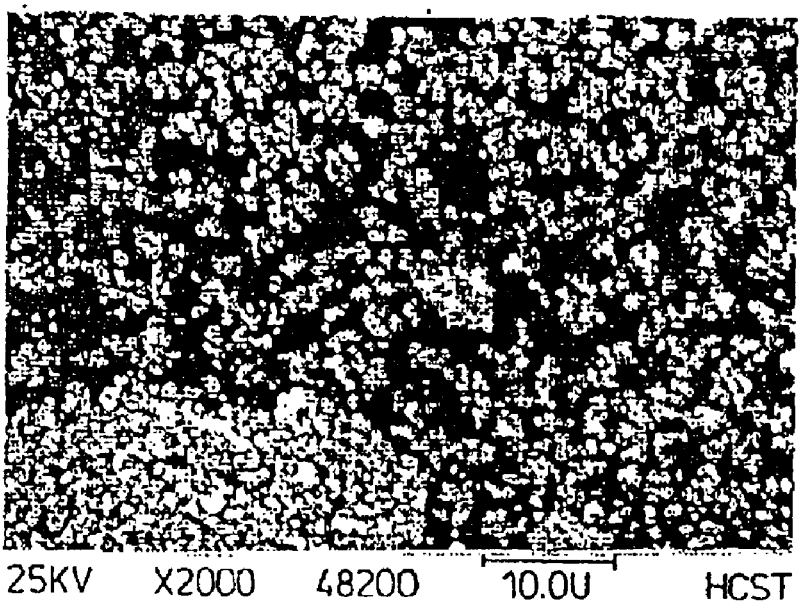
Figure 6:
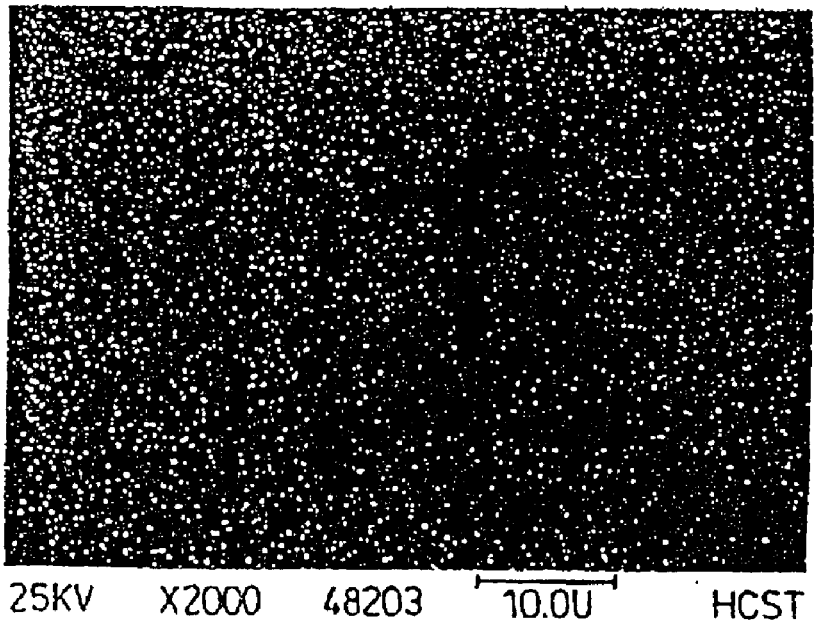
Figure 7:
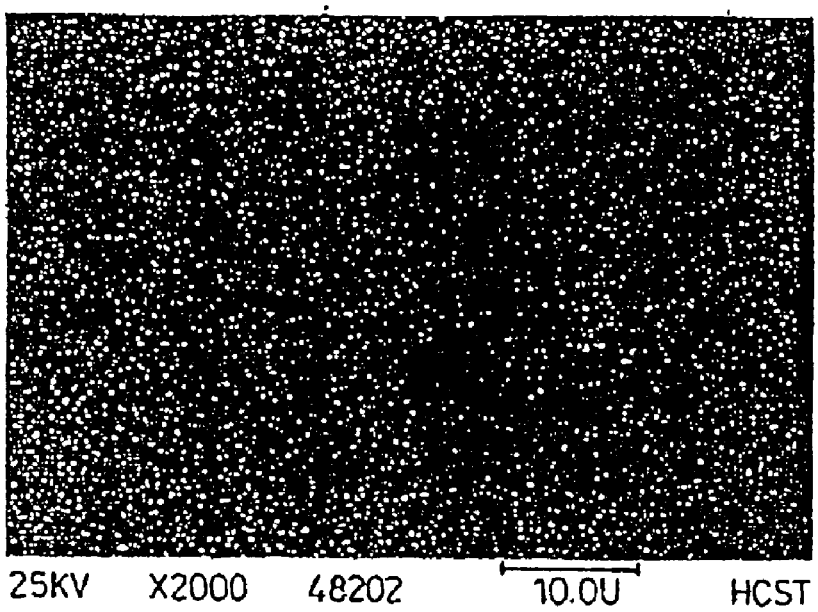
Figure 8:
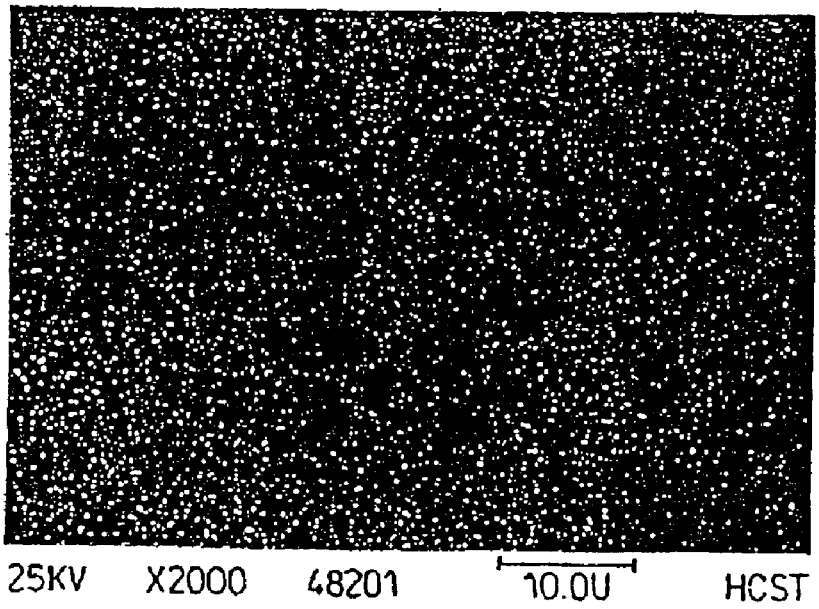

357.7 g of $CoCl_2$*$6H_2O$, 266.04 g of $NiSO_4$*$6H_2O$ and 180.3 $FeCl_2$*$2H_2O$ were dissolved in deionized water to give 2 l of mixed salt solution, and 2 kg of tungsten carbide of the type DS 80 (supplier H.C. Starck) and 1 g of carbon black were dispersed therein for 60 minutes. 5 l of oxalic acid solution containing 480.2 g of $(COOH)_2$*$2H_2O$ were added as precipitant, and the mixture was subsequently stirred for a further 10 minutes in order to complete the precipitation. The mixture was then filtered, the precipitate was washed with deionized water until free of anions and subsequently reduced in a tubular furnace for 90 minutes at 500° C. in an atmosphere comprising 96% by volume of nitrogen and 4% by volume of hydrogen. Besides the principal component tungsten carbide, the resultant composite powder comprised 3.60% of Co, 2.50% of Ni, 2.56% of Fe, 5.53% of carbon total, 0.07% of carbon free, 0.596% of oxygen and 0.0176% of nitrogen. The grain size was measured as FSSS 0.7 $\mu$m, and the grain size distribution by the laser diffraction method was measured as d10=1.69 $\mu$m, d50=3.22 $\mu$m and d90=5.59 $\mu$m. The SEM analysis showed a well deagglomerated composite powder (FIG. 5) with a uniform distribution of the Fe, Co and Ni (FIGS. 6–8).

Example 4

Figure 9:
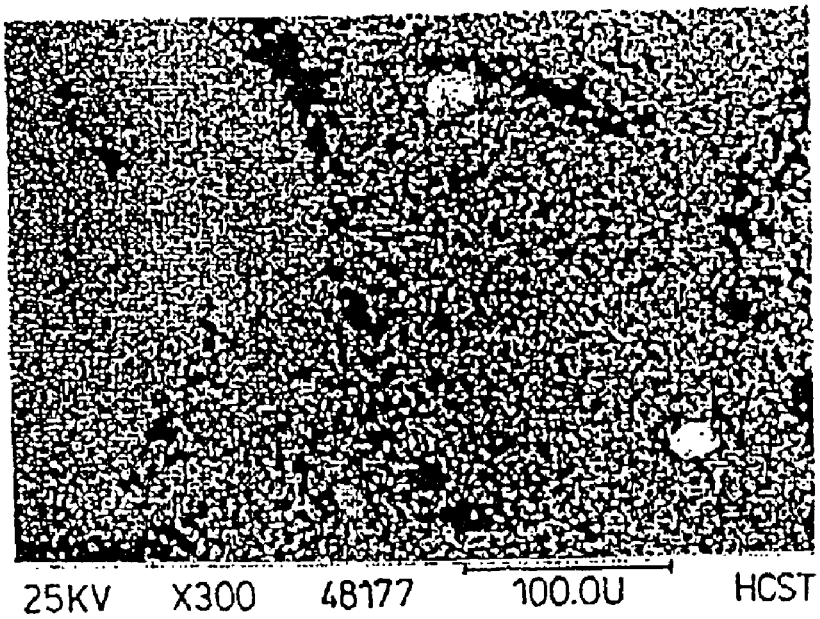
Figure 10:
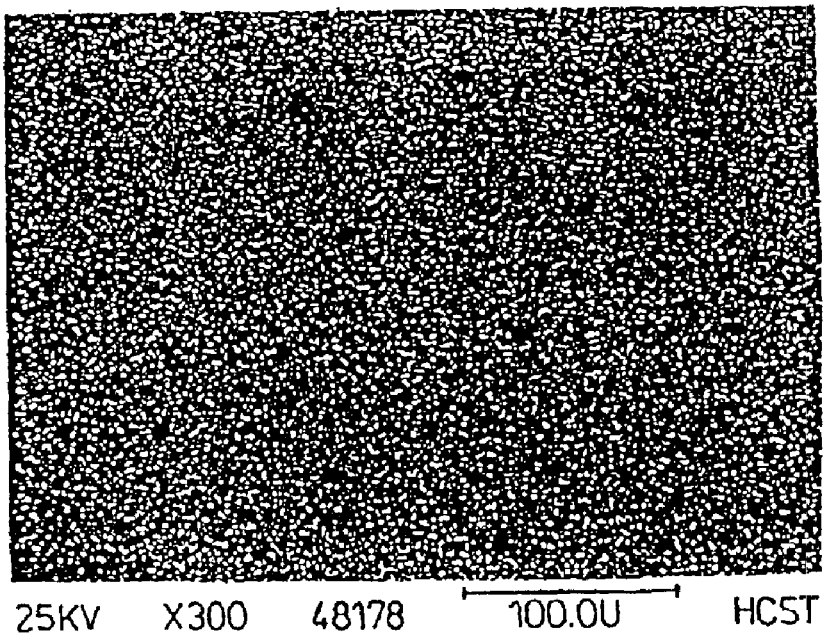
Figure 11:
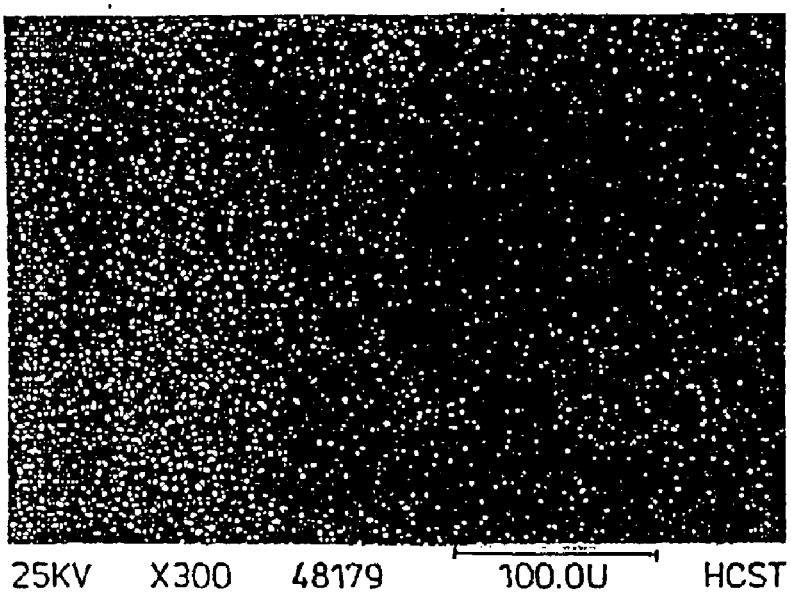

2 kg of tungsten carbide of the type DS 80 and 1 g of carbon black were dispersed for 60 minutes with vigorous stirring in 2 l of solution containing 300.4 g of $FeCl_2$*$2H_2O$ and 443.4 g of $NiSO_4$*$6H_2O$. For precipitation of the Fe and Ni, 489.3 g of $(COOH)_2$*$2H_2O$, dissolved in 1.7 l of deionized water, were added, and the mixture was stirred for a further 10 minutes in order to complete the precipitation. The precipitate was filtered, washed with deionized water until free of anions and spray-dried. This precursor powder was subsequently reduced in a tubular furnace for 90 minutes at 500° C. in a mixture of 96% by volume of nitrogen and 4% by volume of hydrogen. The resultant composite powder exhibited the following chemical composition: 4.46% of Ni, 4.26% of Fe, 5.52% of carbon total, 0.08% of carbon free, 0.653% of oxygen, 0.0196% of nitrogen, remainder tungsten. The grain size was determined as FSSS 0.74 $\mu$m, and the grain size distribution by the laser diffraction method was determined as d10=1.92 $\mu$m, d50=3.55 $\mu$m and d90=6.10 $\mu$m. The SEM analysis shows a well deagglomerated powder (FIG. 9) having a uniform Fe and Ni distribution (FIGS. 10 and 11).

Example 5

Figure 12:
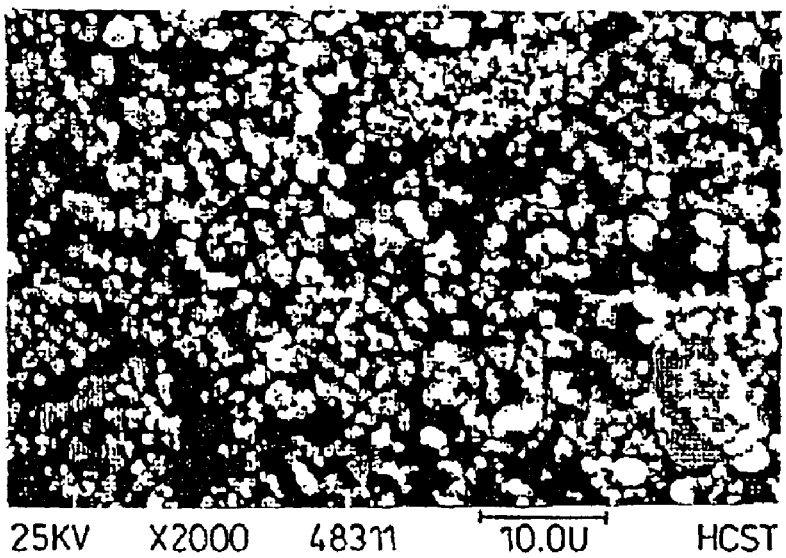
Figure 13:
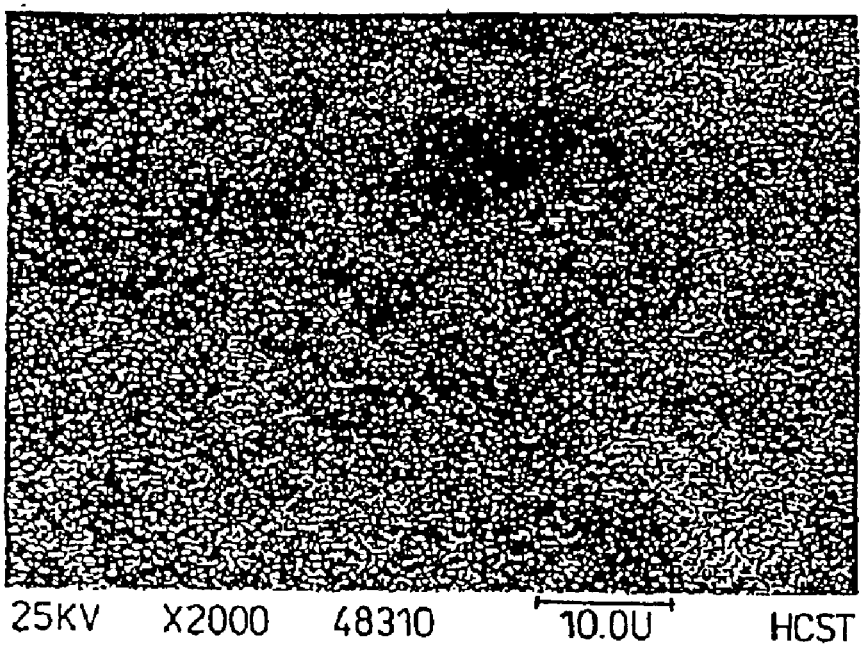

1.6 kg of tungsten metal powder (type HC 100, supplier H.C. Starck) were introduced into a suspension of 872 g of oxalic acid dihydrate in 3.05 l of deionized water, and the mixture was homogeneously dispersed over a stirring duration of 15 minutes. A solution of 1.592 kg of $CuSO_4$*$5H_2O$ in 6 l of deionized water was added, and the resultant precipitation suspension was stirred for a further 30 minutes in order to complete the precipitation and homogenization of the suspension. The precipitate was subsequently filtered, washed with deionized water until free of anions, then spray-dried and reduced in a tubular furnace at 500° C. for 120 minutes under hydrogen. The resultant composite powder comprised 80.78% of W and 18.86% of Cu in addition to a residual oxygen content of 0.37%. The grain size, measured by the FSSS method, was determined as 1.12 $\mu$m, and the grain size distribution using the laser diffraction method was determined as d10=1.64 $\mu$m, d50=5.31 $\mu$m, d90=12.68 $\mu$m. The SEM analysis shows a very fine-grained powder (FIG. 12) and, on energy-dispersive evaluation, a uniform distribution of the copper in the tungsten powder matrix (FIG. 13).

What is claimed is:

1. A process for the preparation of powder mixtures or composite powders comprising, at least one first type of powder selected from the group consisting of high-melting metals having a melting temperature that is at least 2000° C., hard materials and ceramic powders, and at least one second type of powder selected from the group consisting of binder metals, binder-metal mixed crystals and binder-metal alloys, wherein the second type of powder is formed from a precursor compound selected from the group consisting of water-soluble compounds of Co, Ni, Fe, Cu Sn and combinations thereof in the form of water-soluble salts in an aqueous suspension of the first type of powder by precipitation as oxalate, removal of the mother liquor and reduction of the metal, further wherein the first type of powder is initially introduced in aqueous suspension containing the precursor compound of the second type of powder in the form of dissolved salts, and a solution is added to the suspension, said solution being selected from the group consisting of oxalate solution, oxalic acid solution and combinations thereof.

2. The process of claim 1, wherein the high-melting metal of said first type of powder is selected from the group consisting of Mo, W and combinations thereof, the hard material of said first type of powder is selected from the group consisting of WC, TiC, TiN, Ti(C,N), TaC, NbC, $Mo_2C$ and mixed metal carbides thereof, and the ceramic powders of said first type of powder are selected from the groups consisting of $TiB_2$ and $B_4C$.

3. The process of claim 2, wherein the first type of powder is suspended in solution selected from the group consisting of oxalate solution, oxalic acid solution and combinations thereof, and the precursor compound of the second type of powder is added to the suspension in the form of a solution of its water-soluble salts.

4. The process of claim 2, wherein an oxalic acid component is employed in a 1- to 2-fold stoichiometric amount, based on the precursor compound for the second type of powder.

5. The process of claim 2, wherein the aqueous suspension, from which said oxalate is precipitated, has a concentration of from 0.05 to 1.05 mol/l of oxalic acid component.

6. The process of claim 2, wherein the precipitation is carried out with vigorous stirring.

7. The process of claim 2, wherein the mixture or composite of the first type of powder and the precipitate is agglomerated before the reduction.

8. The process of claim 1, wherein an oxalic acid component is employed in a 1- to 2-fold stoichiometric amount, based on the precursor compound for the second type of powder.

9. The process of claim 1, wherein the aqueous suspension, from which said oxalate is precipitated, has a concentration of from 0.05 to 1.05 mol/l of oxalic acid component.

10. The process of claims 1, wherein the precipitation is carried out with vigorous stirring.

11. The process of claim 1, wherein the mixture or composite of the first type of powder and the precipitate is agglomerated before the reduction.

12. A process for the preparation of powder mixtures or composite powders comprising, at least one first type of powder selected from the group consisting of high-melting metals having a melting temperature that is at least 2000° C., hard materials and ceramic powders, and at least one second type of powder selected from the group consisting of binder metals, binder-metal mixed crystals and binder-metal alloys, wherein the second type of powder is formed from a precursor compound selected from the group consisting of water-soluble compounds of Co, Ni, Fe, Cu, Sn and combinations thereof in the form of water-soluble salts in an aqueous suspension of the first type of powder by precipitation as oxalate, removal of the mother liquor and reduction of the metal, further wherein the first type of powder is suspended in a solution selected from the group consisting of oxalate solution, oxalic acid solution and combinations thereof, and the precursor compound of the second type of powder is added to the suspension in the form of a solution of its water-soluble salts.

13. The process of claim 12, wherein the high-melting metal of said first type of powder is selected from the group consisting of Mo, W and combinations thereof, the hard material of said first type of powder is selected from the group consisting of WC, TiC, TiN, Ti(C,N), TaC, NbC, $Mo_2C$ and mixed metal carbides thereof, and the ceramic powders of said first type of powder are selected from the group consisting of $TiB_2$ and $B_4C$.

14. The process of claim 12, wherein an oxalic acid component is employed in a 1- to 2-fold stoichiometric amount, based on the precursor compound for the second type of powder.

15. The process of claim 12, wherein the aqueous suspension, from which said oxalate is precipitated, has a concentration of from 0.05 to 1.05 mol/l of oxalic acid component.

16. The process of claim 12, wherein the precipitation is carried out with vigorous stirring.

17. The process of claim 12, wherein the mixture or composite of the first type of powder and the precipitate is agglomerated before the reduction.

* * * * *